US006279176B1

(12) United States Patent
Aviles

(10) Patent No.: US 6,279,176 B1
(45) Date of Patent: Aug. 28, 2001

(54) LOW WATER TOILET

(75) Inventor: Pedro M. Aviles, Santandu (CO)

(73) Assignee: 1:7 Water Solutions, Inc., Houston, TX (US)

( * ) Notice: Subject to any disclaimer, the term of this patent is extended or adjusted under 35 U.S.C. 154(b) by 0 days.

(21) Appl. No.: 09/616,197

(22) Filed: Jul. 14, 2000

(51) Int. Cl.[7] ..... E03D 3/10

(52) U.S. Cl. ..... 4/354; 4/361; 4/415; 4/422; 4/434; 4/435

(58) Field of Search ..... 4/332, 354, 361, 4/362, 415, 421, 422, 425, 426, 434, 435

(56) References Cited

U.S. PATENT DOCUMENTS

| | | | | |
|---|---|---|---|---|
| 1,281,457 | * | 10/1918 | Whitney et al. | 4/435 |
| 3,780,384 | | 12/1973 | Rivelle . | |
| 3,995,327 | | 12/1976 | Hendrick . | |
| 4,075,718 | | 2/1978 | Hargraves . | |
| 4,183,108 | | 1/1980 | Hamilton . | |
| 4,329,745 | | 5/1982 | Aguero . | |
| 4,561,131 | | 12/1985 | David . | |
| 4,955,921 | * | 9/1990 | Basile et al. | 4/354 |
| 5,175,894 | | 1/1993 | Chen . | |
| 5,369,816 | | 12/1994 | Chen . | |
| 5,774,904 | * | 7/1998 | McWilliams | 4/246.2 |
| 5,862,538 | | 1/1999 | Ho . | |

* cited by examiner

*Primary Examiner*—Gregory L. Huson
*Assistant Examiner*—Tuan Nguyen
(74) *Attorney, Agent, or Firm*—Keeling Law Firm

(57) ABSTRACT

A low volume high-pressure toilet. When the user sits on the toilet seat, a hydraulic piston pressurizes the water tank, which optimally holds 1.7 liters of water. Water is released at high pressure through the toilet interior rim and a lower waterjet, forcing the wastewater down a waste pipe. To minimize velocity pressures losses that would be caused by a p-trap, the waste is released straight down a pipe. Sewer gases are prevented from traveling back up the pipe by a sealing valve that occludes the cross sectional area of the waste cavity in the bottom of the toilet.

7 Claims, 1 Drawing Sheet

LOW WATER TOILET

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This invention relates to a low water toilet. Specifically, the invention describes a toilet using less than 2.0 liters of water, preferably 1.7 liters, at high pressure to flush waste.

2. Related Art

Prior art toilets in permanent structures have been in three types: gravity-tank, pressure-tank and tankless. Gravity tank toilets, the most common in the U.S., have a tank that holds between 6 and 15 liters of water. The water is released through holes in the rim of a toilet bowl and through a lower waterjet, creating a suction effect in a siphon tube that leads to a sewer line. The siphon tube is typically a "P-trap" shape that retains water in the bottom of the "P" loop to prevent sewer gas from backing up from the sewer line. Gravity tank toilets have the limitations of requiring high volumes of water per flush, followed by typically slow refill rates of the water tank.

Pressure-tank toilets are a modified gravity-tank toilet, wherein pressure of inlet water compresses air in an inner tank. This compressed air assists the flush process. However, like the standard gravity-tank toilet, a relatively high volume of water is required for each flush.

Tankless toilets are typically found in commercial locations. They require higher water pressure than gravity tank toilets, but still require a relatively high volume of water for each flush (typically 6 liters or more).

High pressure/low water volume toilets are also described in the prior art. These toilets rely on constriction nozzles that increase the dynamic pressure of the water passing through. These nozzles then direct their spray against the interior surface of the toilet bowl, spraying off the bowl and the waste contained therein. Such systems require an inlet water supply having higher hydrostatic pressure than found in most municipal systems to drive the water through the nozzles.

It would therefore be useful improvement of the prior art for a toilet to efficiently flush waste using a minimal amount of high-pressure water without relying on a remote source of high pressure.

BRIEF SUMMARY OF THE INVENTION

Accordingly, the objectives of this invention are to provide, inter alia, a new and improved low water toilet that:

uses less than 2.0 liters of water per flush;

is capable of creating its own high hydraulic pressure;

does not allow sewer gases to back up; and is cost efficient.

These objectives are addressed by the structure of the inventive toilet. A hydraulic piston pressurizes a water pressure tank. The hydraulic piston is positioned beneath the toilet seat, so that it is depressed when the person sits on the seat. Approximately 300 ml of water are initially in the bowl of the toilet, positioned above a waste tube. A sealing valve retains water and waste in the waste tube. A working lever is pushed to initiate the toilet flushing cycle. When the toilet is flushed, the sealing valve is cycled downward to allow the wastewater to flow out a waste pipe, and simultaneously high-pressure water is released from the water pressure tank though a waterjet in the lower portion of the toilet bowl and from interior rim of the toilet. As the flushing cycle continues, the sealing valve reseals the waste tube, and residual pressure from the water pressure tank fills the tank with the starting level (approximately 300 ml) of water.

To minimize velocity pressures losses that would be caused by a p-trap, the waste is released straight down a pipe. Sewer gases are prevented from traveling back up the pipe by a sealing valve that occludes the cross sectional area of the waste cavity in the bottom of the toilet.

Other objects of the invention will become apparent from time to time throughout the specification hereinafter disclosed.

DETAILED DESCRIPTION OF THE INVENTION

Figure 1:
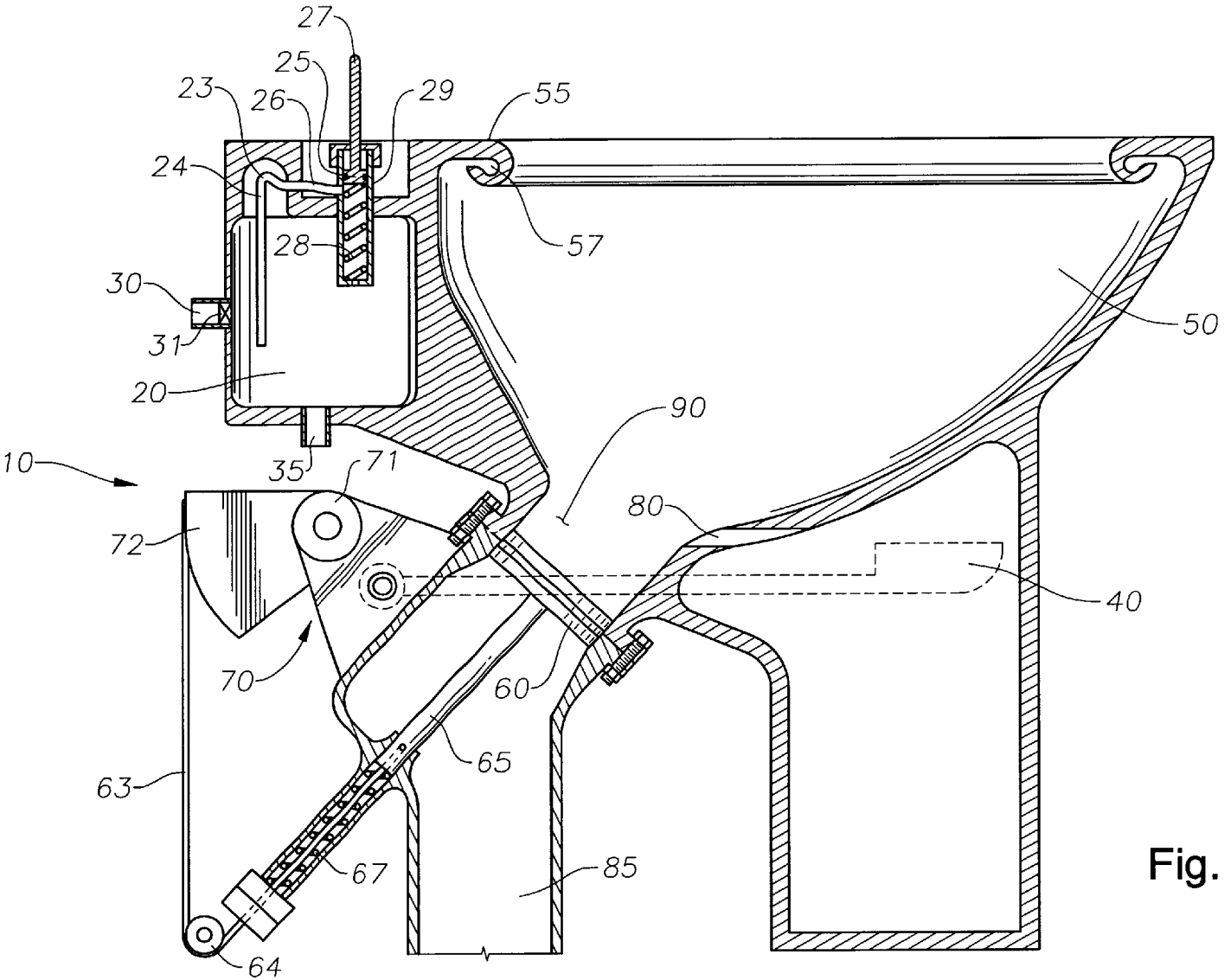
FIG. 1 depicts a partial cutaway side view of the inventive toilet.

The present invention is described as toilet 10, depicted in FIG. 1.

Water storage tank 20 holds water used to flush toilet 10. In the preferred embodiment, water storage tank 20 holds 1.5 to 2.0 liters, preferably 1.7 liters. Connected to water storage tank 20 is water inlet 30. Water inlet 30 preferably includes check valve 31, typically located at the interface of water inlet 30 and water storage tank 20.

Water storage tank 20 is connected and in fluid communication, through pressure line 23 to the interior of piston 29 above hydraulic piston head 25 via hydraulic piston pressure outlet 26. While piston 29 is understood to be a hydraulic piston, it is understood that alternative pressurization mechanisms, including but not limited to pneumatic pumps, may be used in the alternative to accomplish the below described function of piston 29. Piston 29 includes hydraulic piston head 25, piston rod 27 and piston return spring 28. Exiting water storage tank 20 is pressurized water outlet 35, which is connected and in fluid communication by hoses (not shown) to interior rim 57 and waterjet 80.

Working lever 40 is preferably mechanically connected to gearing 70 (not shown), gearing 70 comprising a larger gear (not shown) and pinion gear 71. Working lever 40 is laterally connected with the larger gear (not shown). The larger gear is engaged with pinion gear 71, preferably in an increasing ratio such that angular rotation of the larger gear results in greater angular rotation of pinion gear 71. Pinion gear 71 is laterally connected to lever 72, which translates the rotational movement of pinion gear 71 to linear movement and attaches to linkage wire 63. Linkage wire 63 loops around wire pulley 64 and connects to seal push rod 65. Surrounding and axial to seal push rod 65 is push rod spring 67. Seal push rod 65 is attached to sealing valve 60, which is slidably inserted into and sealing against the inner walls of waste cavity 90. Below waste cavity 90 is waste pipe 85, which leads to a sewer line (not shown).

OPERATION

In the preferred embodiment shown in FIG. 1, toilet 10 works in the following sequence. Note that at the beginning of each flush sequence, a small amount of water, preferably 300 ml, is in the bottom of bowl 50 and in waste cavity 90.

Water enters water storage tank 20 via water inlet 30. Water inlet 30 is connected via a hose, preferably a high-pressure hose, to a water supply, such as a municipal water line. The incoming water pressure is typically in the range of 12–35 psi (82–240 kPa); thus the initial pressure in the water storage tank is initially at this same pressure. The water inlet 30 fills water storage tank 20, which typically has a capacity of less than 2.0 liters, preferably 1.7 liters.

When solid waste is to be evacuated from toilet 10, the following steps occur. The user sits on a toilet seat (not shown), typically attached to the toilet bowl exterior rim 55, oriented above hydraulic piston head 25. The toilet seat presses down on piston rod 27, compressing piston return spring 28. When hydraulic piston head 25 of piston 29 is in a depressed position, water from a line connected to hydraulic piston pressure outlet 26 is pulled into the cavity above piston 29. When the user gets off the toilet seat, piston return spring 28 expands, returning piston 29 to its original position and forcing the water above piston 29 into the line connected to hydraulic piston pressure outlet 26. Thus the water in the line leading from hydraulic piston pressure outlet 26 is now compressed to a high-pressure level proportional to the weight of the person who sat on the toilet seat. The hydraulic pressure in the line leading from hydraulic piston pressure outlet 26 is communicated through pressure line 23 to pressure inlet 24 into water storage tank 20. Pressure line 23 is a high-pressure line, fabricated of metal or reinforced flexible material such as rubber. Alternatively, hydraulic pressure communication between piston 29 and tank 20 may be through a direct conduit or similar connection. The amount of pressure in the tank is adjustable in the preferred embodiment by a pressure regulator (not shown) associated with hydraulic piston head 25 and its related components.

To flush solid waste, the user depresses working lever 40. Gearing 70 (not shown) increases the rotation of pinion gear 71 and its attached lever 72. Linkage wire 63, attached to lever 72, loops around wire pulley 64, and pulls sealing valve 60 by its seal push rod 65 to a second position. Water and waste located in the bottom of bowl 50 and waste cavity 90 are then released down waste pipe 85. When working lever 40 is released, push rod spring 67 expands to return seal push rod 65 to its original first position, thus resealing waste cavity 90. This seal prevents water from flowing down through waste pipe 85, while at the same time preventing noxious and/or hazardous sewer gases from flowing upward from a sewer line (not shown) which is typically attached to waste pipe 85.

Simultaneous with the movement of sealing valve 60 described above, depressing working lever 40 also releases pressurized water from water storage tank 20. Depressing working lever 40 opens a high-pressure water valve (not shown) connected, typically via a first section of high-pressure hose, to pressurized water outlet 35. The pressurized water is directed downstream through two second sections of hose, typically in parallel, leading away from the high-pressure water valve. One of the second sections of hose terminates under the toilet bowl interior rim 57. The other second section of hose terminates at waterjet 80. As the water pressure is released, a high velocity stream from interior rim 57 cleans the interior of bowl 50, while simultaneously a second high velocity stream from waterjet 80 pushes out the wastewater from waste cavity 90 down into waste pipe 85. When working lever 40 is released to its original position, water flowing through the high-pressure water valve is turned off. (Note that shortly after the initial release of high-pressure water, the main source of water pressure through the high-pressure hoses to interior rim 57 and waterjet 80 from water storage tank 20 is that provided by the inlet water supply.) When the high-pressure water valve is turned off, sealing valve 60 simultaneously reseals waste cavity 90. Residual water on the sides of the interior of toilet bowl 50 then drains down into waste cavity 90, providing a pool of approximately 300 ml of water.

When the user wishes to flush only liquid waste, high pressure is not required (although high pressure does not adversely affect flushing of liquid waste). If the user does not sit on the toilet seat, and thus water storage tank 20 is not pressurized by hydraulic piston head 25, the system works on pressure provided by the water supply system, typically less than 35 psig. The operation of toilet 10 is the same as described above without the steps to pressurize water storage tank 20 (since the user does not sit on the toilet seat).

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A low water toilet for waste, comprising a toilet bowl having an interior;

a seat connected to an external rim of said bowl;

a water storage tank having a pressurization means for pressurizing water in said water storage tank; and said pressurization means being activated by a weight of a user when said user upon said seat.

2. The low water toilet as in claim 1 further comprising:

said water storage tank in fluid communication with said toilet bowl interior by a pressurized water distribution means;

said water storage tank in fluid communication with said pressurization means;

said pressurization means comprising a hydraulic piston, a piston return spring and a pressure line;

said hydraulic piston comprising a piston head and a piston rod;

said piston rod located proximate said seat;

said pressure line connected between said hydraulic piston and said water storage tank;

said piston rod being depressed and said piston return spring being compressed when said user sits upon said seat, resulting in water from said pressure line being pulled into a cavity above said piston head;

said piston return spring being expanded when said user gets off said toilet seat, resulting in said water above said piston head being compressed into said pressure line; and said compressed water in said pressure line compressing water in said water storage tank, resulting in a pressurization of said water storage tank.

3. The low water toilet as in claim 2, further comprising;

said pressurized water distribution means comprising a working lever, a valve and a water release hose;

said working lever mechanically connected to said valve;

said water release hose comprising a first section connected between said water storage tank and said valve; and said water release hose comprising at least one second section connected between said valve and said toilet bowl interior.

4. The low water toilet as in claim 1, further comprising:

a sealing valve slidably insertable within a waste cylinder;

said sealing valve retaining said waste within said waste cylinder while in a first position;

said sealing valve slidable to a second position, wherein said waste being released into a waste pipe; and a movement means to slide said sealing valve from said first position to said second position and from said second position to said first position.

5. The low water toilet as in claim 4, further comprising a working lever mechanically connected to said sealing valve.

6. A low water toilet as in claim 1, further comprising:

an inlet water line connected to said water storage tank; and said inlet water line comprising a one-way check valve.

7. A low water toilet as in claim 1, wherein said water storage tank having a capacity of 1.5 to 2.0 liters.

* * * * *